United States Patent [19]

Nakamura

[11] Patent Number: 5,045,887

[45] Date of Patent: Sep. 3, 1991

[54] FIXING DEVICE WITH A SELECTIVELY MOVABLE COVER

[75] Inventor: Yasuo Nakamura, Osaka, Japan

[73] Assignee: Minolta Camera Kabushiki Kaisha, Osaka, Japan

[21] Appl. No.: 564,435

[22] Filed: Aug. 8, 1990

[30] Foreign Application Priority Data

Aug. 9, 1989 [JP] Japan ..... 1-207479

[51] Int. Cl.[5] ..... G03G 15/20; G03G 15/00

[52] U.S. Cl. ..... 355/282; 355/200; 355/290

[58] Field of Search ..... 355/282, 285, 200; 219/469, 216

[56] References Cited

U.S. PATENT DOCUMENTS

| | | | |
|---|---|---|---|
| T. 967,006 | 2/1978 | Hoffman | 219/216 |
| 4,395,109 | 7/1983 | Nakajima et al. | 219/216 |
| 4,460,267 | 7/1984 | Ogawa | 355/251 |

FOREIGN PATENT DOCUMENTS

| | | | |
|---|---|---|---|
| 59-4704 | 1/1984 | Japan . | |
| 0083781 | 4/1988 | Japan | 355/290 |

*Primary Examiner*—Arthur T. Grimley
*Assistant Examiner*—Nestor R. Ramirez
*Attorney, Agent, or Firm*—Willian Brinks Olds Hofer Gilson & Lione

[57] ABSTRACT

The present invention relates to a fixing device for use in an image forming apparatus, which comprises a heating roller, a pressure roller supported so as to be capable of separating from the pressure roller, and a cover movable interlocking with separating the heating roller from the pressure roller for covering a predetermined portion of the heating roller surface in order to prevent an unfixed toner image on a transfer sheet or the hand of an operator from touching the surface of the heating roller as the jammed sheet is removed.

17 Claims, 6 Drawing Sheets

FIXING DEVICE WITH A SELECTIVELY MOVABLE COVER

BACKGROUND OF THE INVENTION

1 Field of the Invention

The present invention relates to a fixing device for an image forming apparatus using an electrophotographic method for use in copying machines and printers.

2. Description of the Related Arts

Conventional fixing devices in image forming apparatus employing an electrophotographic method and used in copying machines and printers are installed within the bottom unit [a] of the copying machine, wherein a movable frame [c] which supports a heating roller [b]is forced upward relative to a stationary frame [e] which supports a pressure roller [d], as shown in FIG. 8. When the top unit [f] is raised from the closed position indicated by the imaginary lines in the drawing to the open position indicated by the solid lines to process a paper jam, movable frame [c] pivotally moves in an upward direction as it is released from the pressure applied by pressing portion [h] of top unit [f] to passive portion [g] at the free end of said frame [c]. The aforesaid action results in heating roller [b] being separated upwardly from pressure roller [d]. Thus, the transfer sheet [i] which is jammed in the fixing portion is freed from the grip between both rollers [b] and [d] and can thereby be readily removed.

Recent copying machines continue to be down-scaled in size, and fixing devices are designed to be as compact as possible. Thus, even when the heating roller [b] and pressure roller [d] are separated, jammed transfer sheet [i] is often extracted from the less troublesome discharge sheet side.

However, unfixed toner [j] remains on the portion of said sheet [i] on the upstream side of both rollers [b] and [d] in the sheet feed direction and when extracting a jammed transfer sheet [i] in the aforesaid manner, said unfixed toner [j] adheres to the surface of the heating roller [b] when transfer sheet [i] comes into contact with heating roller [b]. The aforesaid adhered toner [j] is transferred to the transfer sheet [i] during the next fixing process, thereby soiling the surface of said subsequent transfer sheet [i]. Further, when the jammed transfer sheet [i] extends only slightly downstream from both rollers [b] and [d] in the sheet feed direction, the hand of the operator used to extract said jammed sheet comes near to heating roller [b] and is exposed to the danger of making contact with said heating roller [b].

A fixing device has been proposed wherein a roller to prevent the transfer sheet from rising when said sheet is pulled out is mounted to a stationary frame to prevent the jammed transfer sheet from making contact with the heating roller.

However, because the aforesaid roller is disposed immediately above the sheet feed path of the fixing device on the upstream side of the aforesaid heating roller and pressure roller, as viewed from the sheet transport direction, said roller, rather than being an aid, quite to the contrary actually hinders the travel of the sheet and increases the probability of a jam. The aforesaid roller causes further inconvenient when trying to grasp the sheet from the sheet discharge side so as to extract the jammed sheet if said jammed sheet extends slightly downstream from the heating roller and pressure roller in the sheet transport direction. Even when the jammed sheet can be grasped and extracted as described above, it is difficult to accomplish the removal while avoiding contact of the sheet with the aforesaid roller, and unfixed toner which comes into contact with the aforesaid roller is loosened and falls into the device, thereby causing another disadvantage. When the jammed sheet extends slightly downstream from the heating roller and pressure roller in the sheet transport direction, the hand of the operator used to try and remove the jammed sheet comes near to the heating roller and is exposed to the danger of making contact with said heating roller.

SUMMARY OF THE INVENTION

A main object of the present invention is to provide a fixing device that allow easy processing of transfer sheet jams.

A further object of the present invention is to provide a fixing device that prevents contact between the unfixed toner on the surface of a jammed transfer sheet and the heating roller when extracting a jammed transfer sheet.

A still further object of the present invention is to provide a fixing device allows removal of a jammed sheet without exposing the operator to contact with the heating roller.

These and other objects are accomplished by providing a fixing device having:

a first roller rotatably supported by first support means;

a second roller for fixing an image to a sheet with the first roller and which is supported so as to be capable of separating from the first roller by second support means pivotally connected to the first support means; and cover means attached to the second support means so as to move from a first position to a second position interlocking with the pivotal movement of the second support means for covering a predetermined portion of the second roller surface, said cover means retracting from a pressure contact portion between the first and second rollers at the first position and covering a confronting portion wherein the second roller confronts the first roller at the second position.

These and other objects, advantages and features of the invention will become apparent from the following description thereof taken in conjunction with the accompanying drawings which illustrate a specific embodiment of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

The construction of a first embodiment of fixing device of the present invention is described hereinafter with reference to FIGS. 1 through 4.

Figure 1:
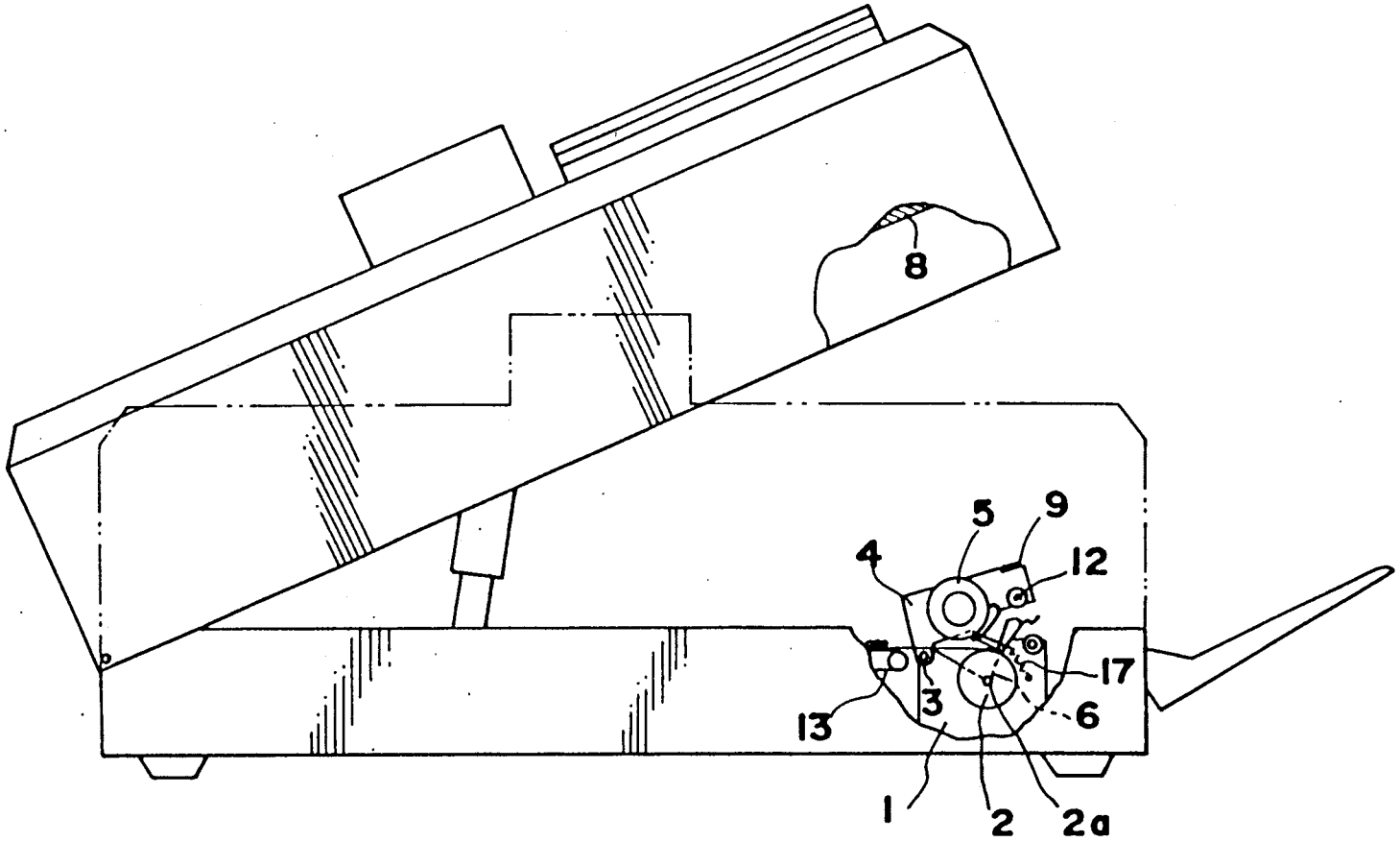
FIG. 1 is a side elevation view of an image forming apparatus with the fixing device of the present invention.

The image forming apparatus shown in FIG. 1 comprises a top unit and a bottom unit, with said top and bottom units being connected such that the top unit is upwardly oscillatable relative to the bottom unit. The first embodiment of the fixing device is provided in the bottom unit of the aforesaid image forming apparatus.

Figure 2:
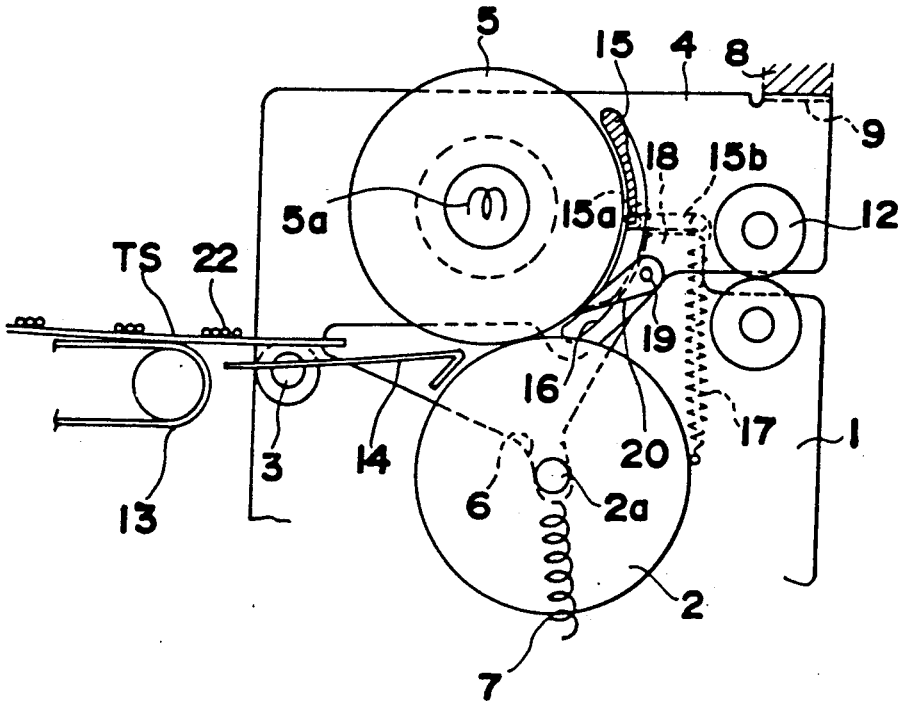
FIG. 2 is a brief section view showing a first embodiment of the fixing device of the present invention in a fusion-capable state.
Figure 3:
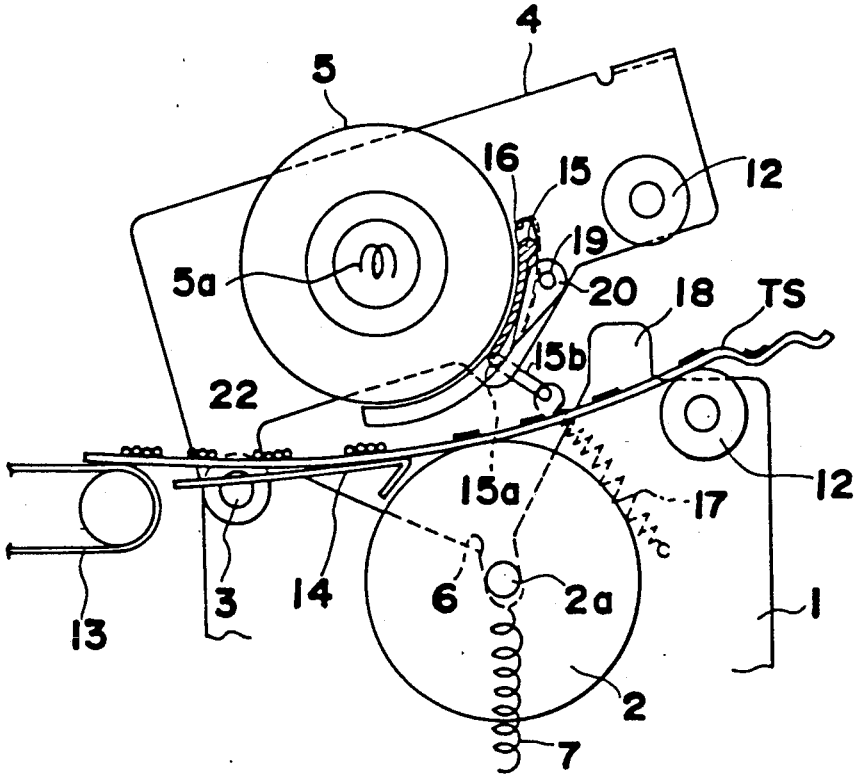
FIG. 3 is a brief section view showing the first embodiment of the fixing device in the jam processing state.

The fixing unit has a stationary frame 1 fixedly attached to the bottom unit and a movable frame 4 connected to said frame 1 by pins 3 on upsteam side of pressure roller 2 and heating roller 5 with respect to the sheet transport direction. Pressure roller 2 is supported by stationary frame 1 by means of a rotatable shaft 2*a*, and heating roller 5 is supported by movable frame 4. Pressure roller 2 is vertically movable along a U-shaped channel 6 because rotating shaft 2*a* of pressure roller 2 rests in said U-shaped channel 6 formed in stationary frame 1. A spring 7 is provided below rotating shaft 2*a*, as shown in FIGS. 2 and 3. The aforesaid spring 7 exerts an upward force on pressure roller 2.

Heating roller 5 has a heating lamp 5*a* installed therein, and is movable between a pressure contact position (FIG. 2) with pressure roller 2 and a separated position (FIG. 3) relative to roller 2 by means of the rotation of movable frame 4 about pins 3.

Figure 4:
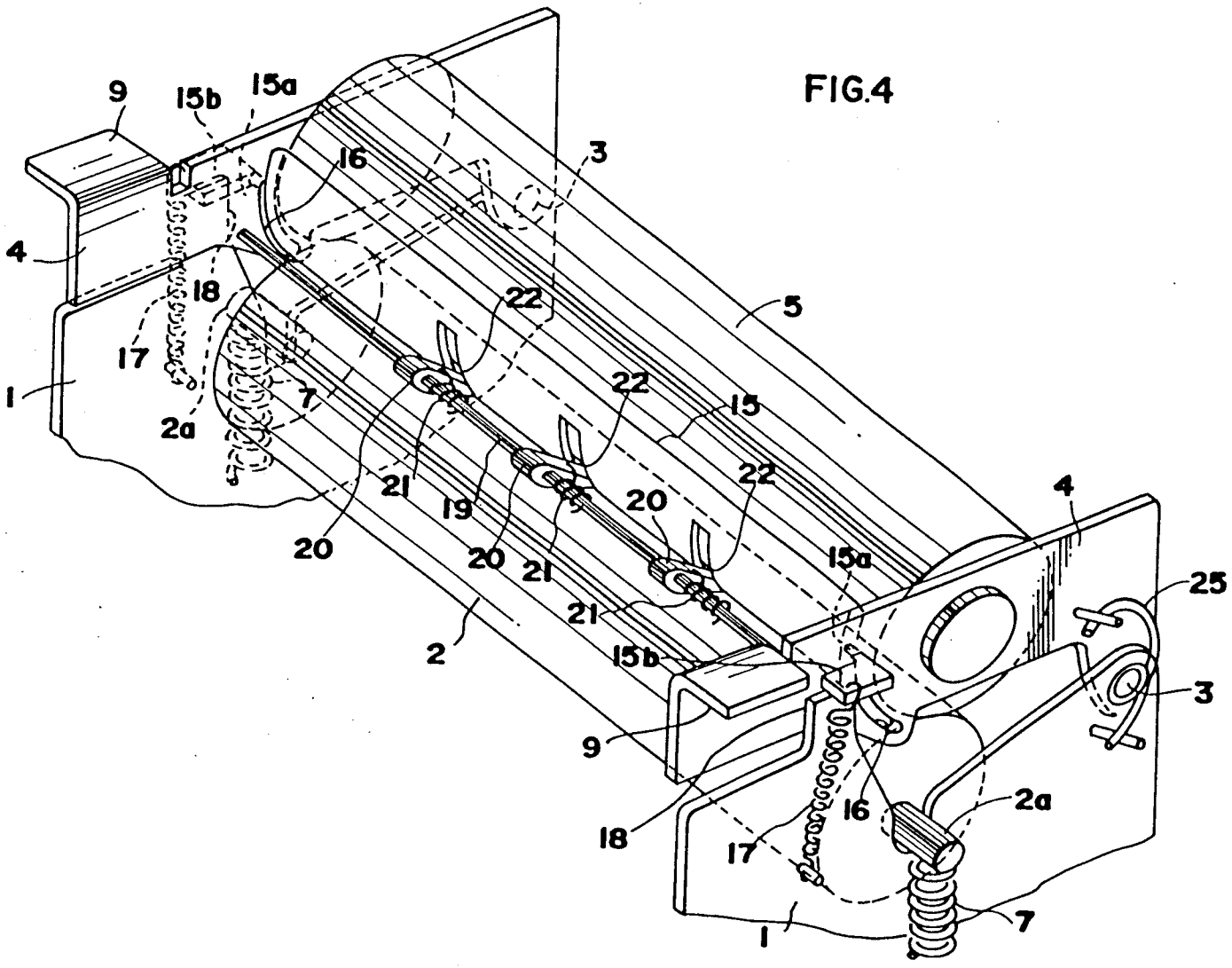
FIG. 4 is a perspective view of the first embodiment of the fixing device.

On the other hand, movable frame 4 is forced upward by a spring 25 provided between said movable frame 4 and stationary frame 1 (see FIG. 4). Accordingly, when the top unit of the image forming apparatus is closed, a pressing portion 8 of the top unit presses downward on passive portion 9 of movable frame 4 to maintain movable frame 4 in the position shown in FIG. 1. Heating roller 5 supported on movable frame 4 is at the contact position with heating roller 2 shown in FIG. 2, and the fixing device is in the fusion-capable state. However, when the top unit is opened upwardly, the downward pressure applied to movable frame 4 by pressing portion 8 of the top unit is released, and movable frame 4 pivotally moves in upward direction due to the upward force exerted by spring 25 and travels to the separated position shown in FIG. 3. Thus, the fixing device is ready for jam processing with heating roller 5 separated from pressure roller 2.

On the sheet discharge side of pressure roller 2 and heating roller 5 is provided a discharge roller pair 12 for discharging transfer sheet TS in the discharge direction following the fixing process. The top roller of roller pair 12 is supported by movable frame 4, and the bottom roller is supported by stationary frame 1.

A transport belt 13 for transporting a transfer sheet TS, which bears a toner image transferred from the surface of a photoconductive drum not shown in the drawings, is positioned upstream of the fixing device in the sheet transport direction. A sheet transport guide 14 is disposed between transport belt 13 and the aforesaid rollers 2 and 5.

A roller cover 15 is arranged around heating roller 5 and is movable along the surface of said heating roller 5. Roller cover 15 is formed in an arced configuration along the surface of heating roller 5 so as to maintain a gap therebetween, and pins 15*a* protruding from both ends of said roller cover 15 engage slots 16 formed in movable frame 4. Slots 16 are formed in the side panels of movable frame 4 having the same center as heating roller 5 with an arc-shaped configuration having a radius of curvature slightly larger than the surface of said heating roller 5. The tip of each pin 15*a* is formed so as to have a receiving portion 15*b* extending in the sheet discharge direction of the fixing device. A spring 17 is arranged between the tip of the aforesaid receiving portion 15*b* and the stationary frame 1.

Spring 17 normally exerts a downward force on receiving portion 15*b* so as to rotate said receiving portion 15*b* clockwise about the center of pins 15*a*.

Separation hooks 20 are supported by shaft 19 on movable frame 4, as shown in FIG. 4. The three separation hooks 20 are independently rotatable on shaft 19. Each separation hook is forced clockwise by the force exerted by springs 21 on shaft 19, so as to be pressed against heating roller 5. Notches 22 are formed in roller cover 15 to avoid interference with separation hooks 20.

The operation of roller cover 15 is described hereinafter.

When the top unit of the image forming apparatus is upwardly opened, the pressure applied to passive portion 9 on movable frame 4 by pressing portion 8 of the top unit is released. The aforesaid release of pressure frees movable frame 4 which then opens upward due to the force exerted by the previously described spring 25, as shown in FIG. 2, and heating roller 5 separates upwardly from pressure roller 2 interlocking with the movement of movable frame 4.

Thus, when the upward movement of movable frame 4 separates heating roller 5 from pressure roller 2 in an upward direction, slot 16 acts as a cam channel and receiving portion 15*b* resting on receiver 18 of the roller cover 15 draws pin 15*a* into the bottom end of slot 16 while pulling pin 15*a* to the side opposite to the sheet discharge direction. Receiving portion 15*b* is removed from the roller cover receiver 18 by the aforesaid drawing action. Free receiving portion 15*b* rapidly moves downward relative to movable frame 4 through the force exerted by spring 17 until pin 15*a* reaches the bottom edge of slot 16. Roller cover 15 arrives in the first position at heating roller 5 opposite pressure roller 2 and covers the surface thereof on the discharge side interlocking with the movement of pins 15*a*, as shown in FIG. 3.

The clockwise rotational force operates upon a center at pins 15*a* and is applied to receiving portion 15*b* by spring 17, and stabilizes when the bottom edge of roller cover 15 makes light contact with the surface of heating roller 5.

Accordingly, a jammed transfer sheet TS can be readily extracted from the sheet discharge side, such that even when the transfer sheet TS is excessively lifted so as to make contact with heating roller 5, said transfer sheet TS touches the roller cover 15 and does not touch heating roller 5, thereby preventing the unfused toner 22 from adhering to the surface of heating roller 5.

Further, when a jammed sheet TS extends slightly toward the sheet discharge side from pressure roller 2 and heating roller 5 and the jammed sheet extraction operation is done, the hand of the operator extracting said jammed sheet TS is prevented from touching heating roller 5 and only touches the roller cover 15 when it approaches said heating roller.

The movement of the roller cover 15 from the position shown in FIG. 3 to the position shown in FIG. 2, may be accomplished with the top unit of the machine closed, and the movable frame 4 of the 15 fixing device closed. Receiving portion 15*b* acts against the force of spring 17 when moving toward the movable frame 4 closed position, and rotates counterclockwise about a center at pin 15*a*. At that time, pin 15*a*, which is positioned at the bottom edge of slot 16, moves upward inside said slot 16 in conjunction with the counterclockwise rotation of receiving portion 15*b*. Roller cover 15 also travels upward along the surface of heating roller 5 with the upward movement of pin 15*a*. Receiving portion 15*b*, which is rotating counterclockwise about a center at pin 15 moving with the previously described upward movement, is stopped by roller cover receiver 18 of stationary frame 1, and at the same time roller cover 15 is maintained in at the second position, as shown in FIG. 2.

Accordingly, the transfer sheet bearing the transferred toner image is transported to the fixing device and passes between fixing rollers 2 and 5 without hindrance from roller cover 15.

Figure 5:
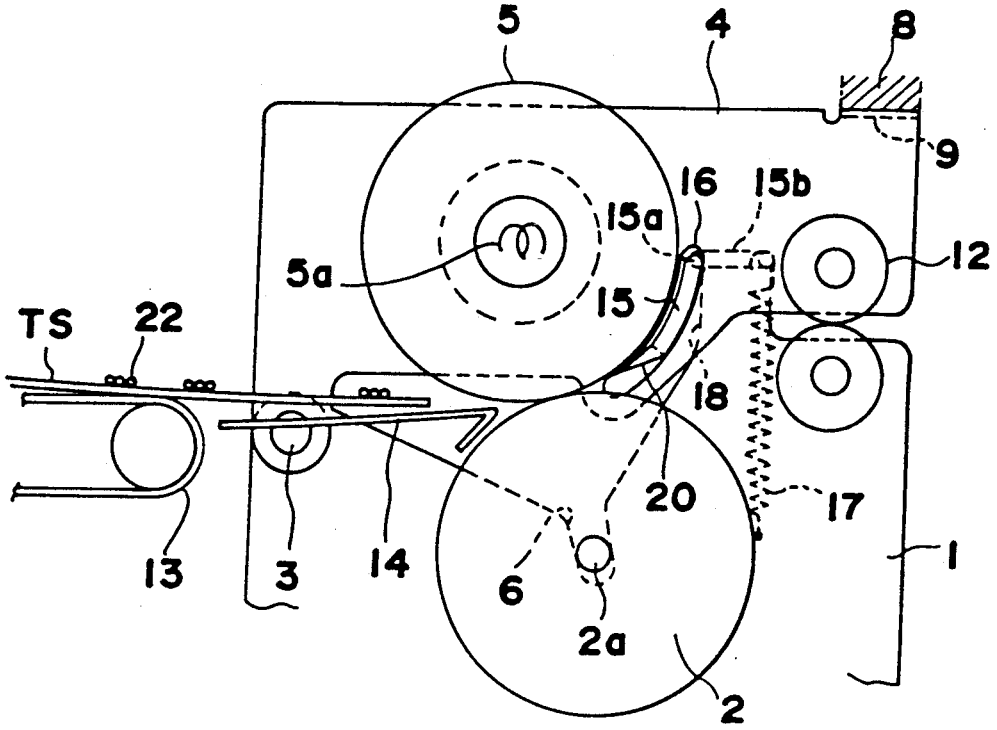
FIG. 5 is a brief section view showing a second embodiment of the fixing device of the present invention in a fusion-capable state.
Figure 6:
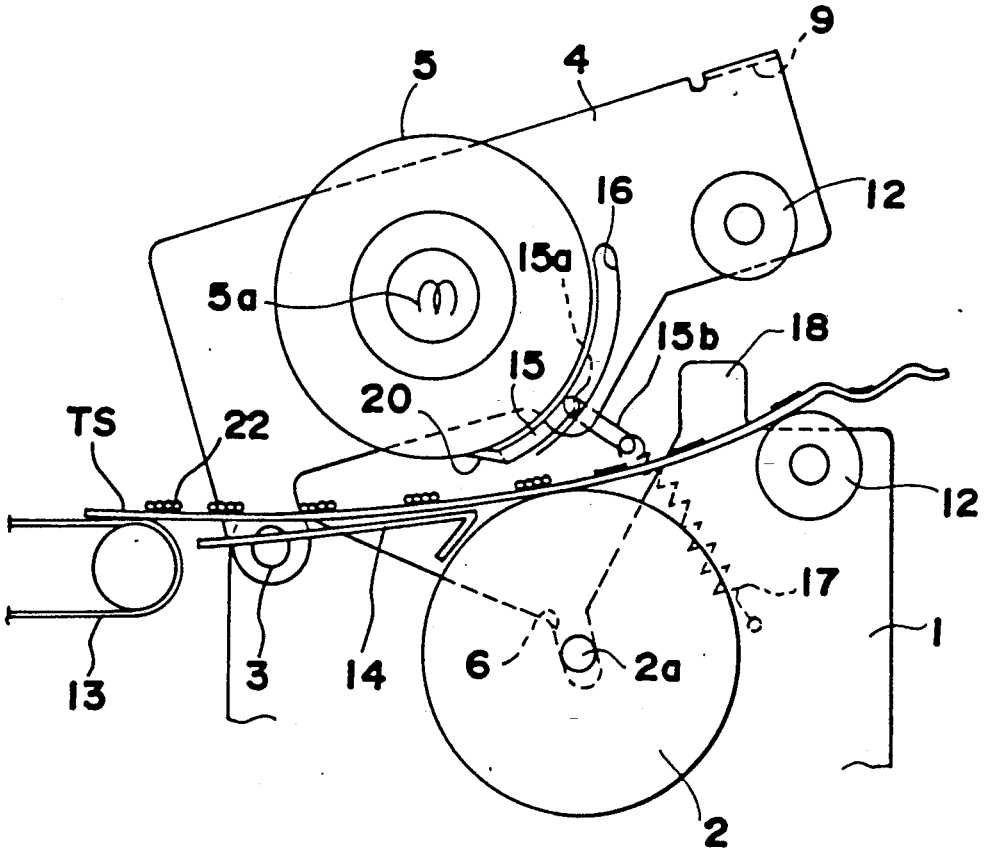
FIG. 6 is a brief section view showing the second embodiment of the fixing device in the jam processing state.
Figure 7:
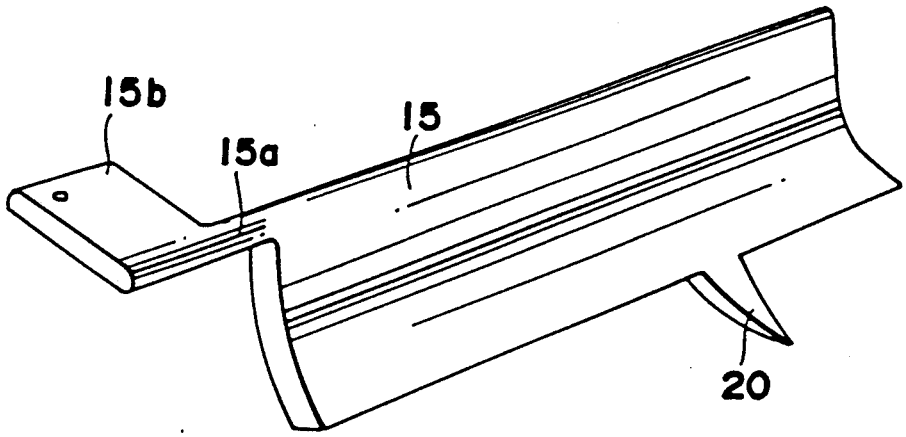
FIG. 7 is a perspective view of the roller cover of the second embodiment of the fixing device.
Figure 8:
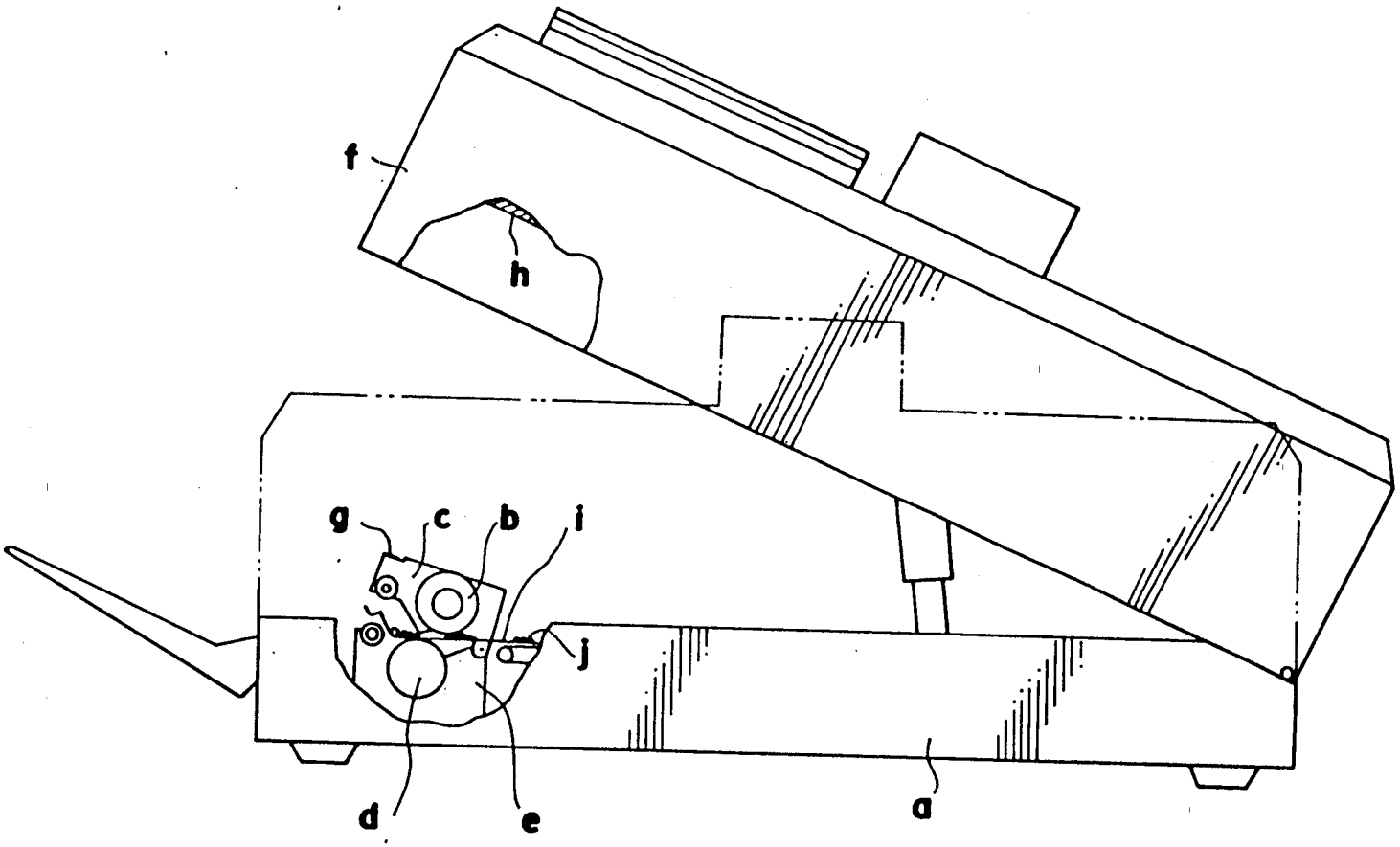
FIG.8 PRIOR ART
FIG. 8 is a side elevation view of a conventional copying machine.

A second embodiment of the invention shown in FIGS. 5 through 7 differs from the first embodiment only inasmuch as roller cover 15 and separating hooks 20 are formed as a single integrated unit. In this embodiment, when roller cover 15 is stabilized at the second position, separation hooks 20 may make brushing contact with the surface of heating roller 5 or may apply slight pressure thereto.

This embodiment may also have a simplified construction wherein the separation hooks 20 are not required to be provided independently from the roller cover 15.

Separation hooks 20 may be attached to roller cover 15, or be supported thereby even when not formed as a single integrated unit with said roller cover 15.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus comprising:

first support means for rotatably supporting a first fixing roller;

second support means pivotably and rotatably supporting a second fixing roller, said second fixing roller being capable of separating from said first fixing roller by the pivotal movement of said second support means; and cover means attached to the second support means and movable from a first position to a second position for covering a predetermined portion of the second fixing roller surface, said cover means retracting from a confronting portion where the second fixing roller confronts the first fixing roller at said first position and covers said confronting portion at said second position.

2. An image forming apparatus as claimed in claim 1 wherein said cover means moves from the second position to the first position when the second fixing roller presses in contact with the first fixing roller.

3. An image forming apparatus as claimed in claim 1 wherein the body of the image forming apparatus includes a first unit and second unit upwardly openable with respect to said first unit, said first unit accommodating the first and second support means.

4. An image forming apparatus as claimed in claim 3 wherein the second support means pivotally moves interlocking with the open and shut movement of the second unit.

5. A fixing device provided to an image forming apparatus, comprising:

a first roller rotatably supported by first support means;

a second roller for fixing an image to a sheet with said first roller, said second roller rotatably supported so as to be capable of separating from said first roller by second support means pivotally connected to said first support means; and cover means attached to the second support means so as to move from a first position to a second position in interlocking relation with the pivotal movement of the second support means for covering a predetermined portion of the second roller surface, said cover means retracting from a confronting portion wherein the second roller confronts the first roller at said first position and covering said confronting portion at said second position.

6. A fixing device as claimed in claim 5 wherein said cover means moves from the second position to the first position when the second roller presses in contact with the first roller.

7. A fixing device as claimed in claim 5 wherein the body of the image forming apparatus includes a first unit and second unit upwardly openable with respect to said first unit, said first unit accommodating the first and second rollers

8. A fixing device as claimed in claim 7 wherein the second support means is urged upwardly by a spring, said second support means being pivotally moved in a downward direction against the force of said spring in order to press the second roller in contact with the first roller when the first unit is shut, and being pivotally moved in an upward direction by the force of the spring when the first unit is opened.

9. A fixing device as claimed in claim 5 wherein said second support means has separation means including a plurality of separation hooks for separating a sheet from the surface of the second roller, said separation hooks being rotatable independently of each other and pressing the surface of the second roller through a plurality of notch portions formed at the cover means.

10. A fixing device as claimed in claim 5 wherein said cover means includes a separation portion wherein the cover means presses the surface of the second roller to separate the sheet therefrom.

11. A fixing device as claimed in claim 5 wherein said second roller is a heating roller for fixing the image on the sheet.

12. A fixing device as claimed in claim 11 wherein said first roller is a pressure roller for pressing said heating roller through the sheet.

13. An image forming apparatus comprising:

accommodating means having a first unit and a second unit pivotally movable in an upward direction with respect to said first unit;

fixing means accommodated within said accommodating means and including a first fixing roller and a second fixing roller which is supported so as to be capable of separating from said first fixing roller, a predetermined portion of said second fixing roller surface being exposed when the second unit is pivotally moved; and cover means for covering the exposed portion of the second fixing roller surface in interlocking relation with the pivotal movement of the second unit.

14. An image forming apparatus as claimed in claim 13, further comprising:

separating means for separating the second fixing roller from the first fixing roller interlocking with the pivotal movement of the second unit.

15. In a fixing device wherein a sheet is gripped between a first roller and a second roller to fix a developed image, a method comprising the steps of:

supporting said first and second rollers so as to be capable of separating from each other;

providing cover means for covering a predetermined portion of the second roller surface; and moving said cover means from a first position to a second position parallelly with separating the second roller from the first roller, said cover means retracting from a confronting portion where the second roller confronts the first roller at said first position and covering said confronting portion at said second position.

16. A method as claimed in claim 15, further comprising the step of:

moving the cover means from the second position to the first position when the first roller presses in contact with the second roller.

17. An image forming apparatus comprising:

a first unit and a second unit pivotally provided with respect to the first unit;

first support means accommodated in the first unit for rotatably supporting a first fixing roller and;

second support means accommodated in the first unit and pivotable with the pivotal movement of the second unit for rotatably supporting a second fixing roller, said second fixing roller being capable of separating from the first fixing roller by the pivotal movement of the second support means; and cover means attached to the second support means and movable from a first position to a second position for covering a predetermined portion of the second fixing roller surface, said cover means retracting from a confronting portion where the second fixing roller confronts the first fixing roller at the first position and covering said confronting portion at the second position.

* * * * *

UNITED STATES PATENT AND TRADEMARK OFFICE

CERTIFICATE OF CORRECTION

PATENT NO. : 5,045,887

DATED : September 3, 1991

INVENTOR(S) : Yasuo Nakamura

It is certified that error appears in the above-identified patent and that said Letters Patent is hereby corrected as shown below:

In col. 5, line 8, delete "15".

In col. 5, line 65 (claim 1, line 13), change "where" to --when--.

In col. 6, line 30 (claim 5, line 16), change "wherein" to --when--.

In col. 7, last line (claim 15, line 11), change "where" to --when--.

In col. 8, line 25 (claim 17, line 16), change "where" to --when--.

Signed and Sealed this

Ninth Day of March, 1993

*Attest:*

*Attesting Officer*

STEPHEN G. KUNIN

*Acting Commissioner of Patents and Trademarks*